US011788753B2

(12) United States Patent
Brahme et al.

(10) Patent No.: US 11,788,753 B2
(45) **Date of Patent: *Oct. 17, 2023**

(54) HVAC SYSTEM FAULT PROGNOSTICS AND DIAGNOSTICS

(71) Applicant: Lennox Industries Inc., Richardson, TX (US)

(72) Inventors: Amita Brahme, Dallas, TX (US); Umesh Gokhale, Irving, TX (US)

(73) Assignee: Lennox Industries Inc., Richardson, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/645,522

(22) Filed: Dec. 22, 2021

(65) Prior Publication Data

US 2022/0113046 A1 Apr. 14, 2022

Related U.S. Application Data

(63) Continuation of application No. 16/806,258, filed on Mar. 2, 2020, now Pat. No. 11,268,720.

(51) Int. Cl.
*F24F 11/38* (2018.01)
*F24F 140/12* (2018.01)

(52) U.S. Cl.
CPC ..... *F24F 11/38* (2018.01); *F24F 2140/12* (2018.01)

(58) Field of Classification Search
CPC ..... F24F 11/38; F24F 2140/12; F25B 2700/1931; F25B 2700/1933; F25B 2700/21151; F25B 2700/21153
See application file for complete search history.

(56) References Cited

U.S. PATENT DOCUMENTS

| | | | | |
|---|---|---|---|---|
| 11,268,720 | B2 * | 3/2022 | Brahme | F24F 11/38 |
| 2008/0083236 | A1 | 4/2008 | Song | |
| 2019/0056161 | A1 | 2/2019 | Auyer et al. | |
| 2019/0331374 | A1 * | 10/2019 | Xue | F25B 49/022 |
| 2021/0270482 | A1 | 9/2021 | Brahme et al. | |
| 2021/0270483 | A1 | 9/2021 | Brahme et al. | |
| 2021/0270484 | A1 | 9/2021 | Brahme et al. | |

* cited by examiner

*Primary Examiner* — Marc E Norman
(74) *Attorney, Agent, or Firm* — Baker Botts L.L.P.

(57) ABSTRACT

A controller of an HVAC system monitors a suction-side property and a liquid-side property over a period of time. The controller determines whether the suction-side property has an increasing or decreasing trend over the period of time. The controller determines whether the liquid-side property has an increasing or decreasing trend. In response to determining that both the suction-side property and the liquid-side property have an increasing trend over the period of time, a fan fault is detected. In response to determining that the suction-side property has a decreasing trend and the liquid-side property has an increasing trend over the period of time, a blockage of a refrigerant conduit subsystem is detected. In response to determining that both the suction-side property and the liquid-side property have a decreasing trend over the period of time, a blower fault is detected.

20 Claims, 6 Drawing Sheets

200

| FAULT TYPE | SUCTION-SIDE PROPERTY 108b | LIQUID-SIDE PROPERTY 110b |
|---|---|---|
| FAN ERROR-INDUCED FAULT | INCREASING TREND | INCREASING TREND (HIGH PRESSURE TRIP) |
| BLOCKAGE-INDUCED FAULT | DECREASING TREND (LOW PRESSURE TRIP) | INCREASING TREND (HIGH PRESSURE TRIP) |
| BLOWER ERROR-INDUCED FAULT | DECREASING TREND (LOW PRESSURE TRIP) | DECREASING TREND |

HVAC SYSTEM FAULT PROGNOSTICS AND DIAGNOSTICS

CROSS-REFERENCE TO RELATED APPLICATIONS

This application is a continuation of U.S. patent application Ser. No. 16/806,258 filed Mar. 2, 2020, by Amita Brahme et al., and entitled "HVAC SYSTEM FAULT PROGNOSTICS AND DIAGNOSTICS," which is incorporated herein by reference.

TECHNICAL FIELD

The present disclosure relates generally to heating, ventilation, and air conditioning (HVAC) systems and methods of their use. In particular, the present disclosure relates to HVAC system fault prognostics and diagnostics.

BACKGROUND

Heating, ventilation, and air conditioning (HVAC) systems are used to regulate environmental conditions within an enclosed space. Air is cooled or heated via heat transfer with refrigerant flowing through the system and returned to the enclosed space as conditioned air.

SUMMARY OF THE DISCLOSURE

In an embodiment, a heating, ventilation and air conditioning (HVAC) system includes a suction-side sensor positioned and configured to measure a suction-side property associated with refrigerant provided to an inlet of a compressor of the system. The system includes a liquid-side sensor positioned and configured to measure a liquid-side property associated with the refrigerant provided from an outlet of the compressor. The system includes a controller communicatively coupled to the suction-side sensor and the liquid-side sensor. The controller monitors the suction-side property and the liquid-side property over a period of time. The controller determines whether the suction-side property has an increasing or decreasing trend over the period of time (e.g., and that the compressor speed and outdoor temperature are not varying over the period of time). The controller determines whether the liquid-side property has an increasing or decreasing trend. In response to determining that both the suction-side property and the liquid-side property have an increasing trend over the period of time, a fan fault is detected. In response to determining that the suction-side property has a decreasing trend and the liquid-side property has an increasing trend over the period of time, a blockage of a refrigerant conduit subsystem is detected. In response to determining that both the suction-side property and the liquid-side property have a decreasing trend over the period of time, a blower fault is detected.

In another embodiment, an HVAC system includes a suction-side sensor positioned and configured to measure a suction-side property associated with refrigerant provided to an inlet of a compressor of the system. The system includes a shutoff switch communicatively coupled to the suction-side sensor and configured to be tripped and automatically stop operation of the compressor in response to determining that the suction-side property is less than a predefined minimum value. The system includes a liquid-side sensor positioned and configured to measure a liquid-side property associated with the refrigerant provided from an outlet of the compressor. The system includes a controller communicatively coupled to the shutoff switch and the liquid-side sensor. The controller stores measurements of the liquid-side property over an initial period of time. The controller detects that the shutoff switch is tripped at a first time stamp corresponding to an end of the initial period of time. The controller accesses the measurements of the liquid-side property. The controller determines, based on the measurements of the liquid-side property, whether the liquid-side property has an increasing or a decreasing trend. In response to determining that the liquid-side property has the decreasing trend, a malfunction of a blower of the system is determined to have caused the shutoff switch to trip. In response to determining that the liquid-side property has the increasing trend, a blockage of the refrigerant conduit subsystem is determined to have caused the shutoff switch to trip.

In yet another embodiment, an HVAC system includes a liquid-side sensor positioned and configured to measure a liquid-side property associated with the refrigerant provided from an outlet of a compressor of the system. The system includes a shutoff switch communicatively coupled to the liquid-side sensor and configured to be tripped and automatically stop operation of the compressor and fan, in response to determining that the liquid-side property is greater than a predefined maximum value. The system includes a suction-side sensor positioned and configured to measure a suction-side property associated with refrigerant provided to an inlet of the compressor. The system includes a controller communicatively coupled to the shutoff switch and the suction-side sensor. The controller stores measurements of the suction-side property over an initial period of time. The controller detects that the shutoff switch is tripped at a first time stamp corresponding to an end of the initial period of time. The controller accesses the measurements of the suction-side property. The controller determines, based on the measurements of the suction-side property, whether the suction-side property has an increasing or decreasing trend. In response to determining that the suction-side property has the increasing trend, the controller determines that a malfunction of a fan caused the shutoff switch to trip. In response to determining that the suction-side property has the decreasing trend, the controller determines that a blockage of the refrigerant conduit subsystem caused the shutoff switch to trip.

HVAC systems include several components which may fail throughout the lifetime of the system, resulting in a system fault. As an example, a system fault may be caused by a loss of refrigerant from the HVAC system, a blockage of the flow of refrigerant through the HVAC system, a malfunction of the fan of an HVAC system, a malfunction of the blower of an HVAC system or the like. Conventional approaches to detecting HVAC system faults generally rely on a user of the system recognizing a loss of system performance (e.g., a user noticing that heating or cooling is no longer being achieved as desired). For example, an occupant of an enclosed space being conditioned by an HVAC system may recognize that the space is not comfortable or is not reaching a desired temperature setpoint. Such approaches result in delayed detection of system faults, such that it may be too late to take effective corrective action once a fault is identified. For instance, by the time a fault is detected using conventional approaches, damage may have occurred to one or more system components, resulting in a need for repairs which may be costly, complex, or even impossible. Moreover, using previous technology, no information is provided with regard to which component of the HVAC system failed or malfunctioned to cause the fault.

This disclosure solves problems of previous systems, including those recognized above, by providing systems and methods for detecting a system fault and determining the underlying cause of the detected fault. For example, properties (e.g., or trends in properties) of the refrigerant flowing in different portions of an HVAC system may be used to forecast likely system faults and provide an alert related to the likely fault(s), such that corrective action may be taken before the HVAC system fails or is shut down. In some embodiments, this disclosure provides for determining the underlying causes of system faults (e.g., whether a fault is caused by a blockage of refrigerant flow, a fan malfunction, or a blower malfunction), thereby allowing appropriate corrective actions to be taken more efficiently. As such, the approaches described in this disclosure may incorporated into practical applications to improve the performance of HVAC systems by anticipating malfunctions of components of the system and/or identifying the cause of a failure of the HVAC system.

In some cases, an HVAC system may include a high-pressure shutoff switch, which causes the HVAC system to stop operating when a maximum liquid pressure is reached, and/or a low-pressure shutoff switch, which is triggered and causes the HVAC system to stop operating when a minimum suction pressure is reached. There exists an unmet need to (1) identify conditions which would lead to one of these shutoff switches being tripped and (2) identify the underlying components which malfunctioned causing the shutoff switches being tripped. This disclosure encompasses solutions to these unmet needs. For example, some embodiments of this disclosure provide systems, methods and devices for detecting likely system faults and the underlying causes based on trends in monitored system properties (e.g., based on trends in suction and liquid temperature or pressure measurements), as described in greater detail below with respect to FIGS. 1-3. As another example, this disclosure provides systems, methods and devices for determining the underlying cause of a low-pressure shutoff switch being tripped, as described in greater detail below with respect to FIGS. 1, 2A-D, and 4. As yet another example, this disclosure provides systems, methods and devices for determining the underlying cause of a high-pressure shutoff switch being tripped, as described in greater detail below with respect to FIGS. 1, 2A-D, and 5.

Certain embodiments may include none, some, or all of the above technical advantages. One or more other technical advantages may be readily apparent to one skilled in the art from the figures, descriptions, and claims included herein.

BRIEF DESCRIPTION OF THE DRAWINGS

For a more complete understanding of the present disclosure, reference is now made to the following description, taken in conjunction with the accompanying drawings, in which.

DETAILED DESCRIPTION

Embodiments of the present disclosure and its advantages are best understood by referring to FIGS. 1 through 6 of the drawings, like numerals being used for like and corresponding parts of the various drawings.

As described above, prior to the present disclosure, there was a lack of tools for effectively detecting HVAC system faults and for determining the underlying cause of such system faults. The systems and methods described in this disclosure provide solutions to these problems by facilitating prognostics and diagnostics of HVAC system faults. For example, as described with respect to FIG. 3 below, trends in a suction-side property and a liquid-side property of refrigerant flowing the HVAC system may be monitored to identify upcoming system faults and provide an advanced indication of the suspected underlying cause of the anticipated fault, thereby facilitating preventative maintenance. As described with respect to FIG. 4 below, if a shutoff switch associated with the suction-side property falling below a minimum value is tripped, trends in the liquid-side property over time may be evaluated to determine the underlying cause of switch's having been tripped. As described with respect to FIG. 5 below, if a shutoff switch associated with the liquid-side property increasing above a maximum value is tripped, trends in the suction-side property over time may be evaluated to determine the underlying cause of switch's having been tripped.

As used in this disclosure a "suction-side property" refers to a property (e.g., a temperature or pressure) associated with refrigerant provided to an inlet of the compressor. For example, a suction-side property may be a temperature or pressure of refrigerant provided to a compressor of an HVAC system (e.g., refrigerant flowing into the inlet of the compressor or refrigerant flowing in conduit leading to the inlet of the compressor. As used in this disclosure, a "liquid-side property" refers to a property (e.g., a temperature or pressure) associated with refrigerant provided from an outlet of the compressor. For example, a liquid-side property may be a temperature or pressure of refrigerant provided from a compressor of an HVAC system (e.g., refrigerant flowing out of the outlet of the compressor or refrigerant flowing in conduit leading from the outlet of the compressor.

HVAC System

Figure 1:
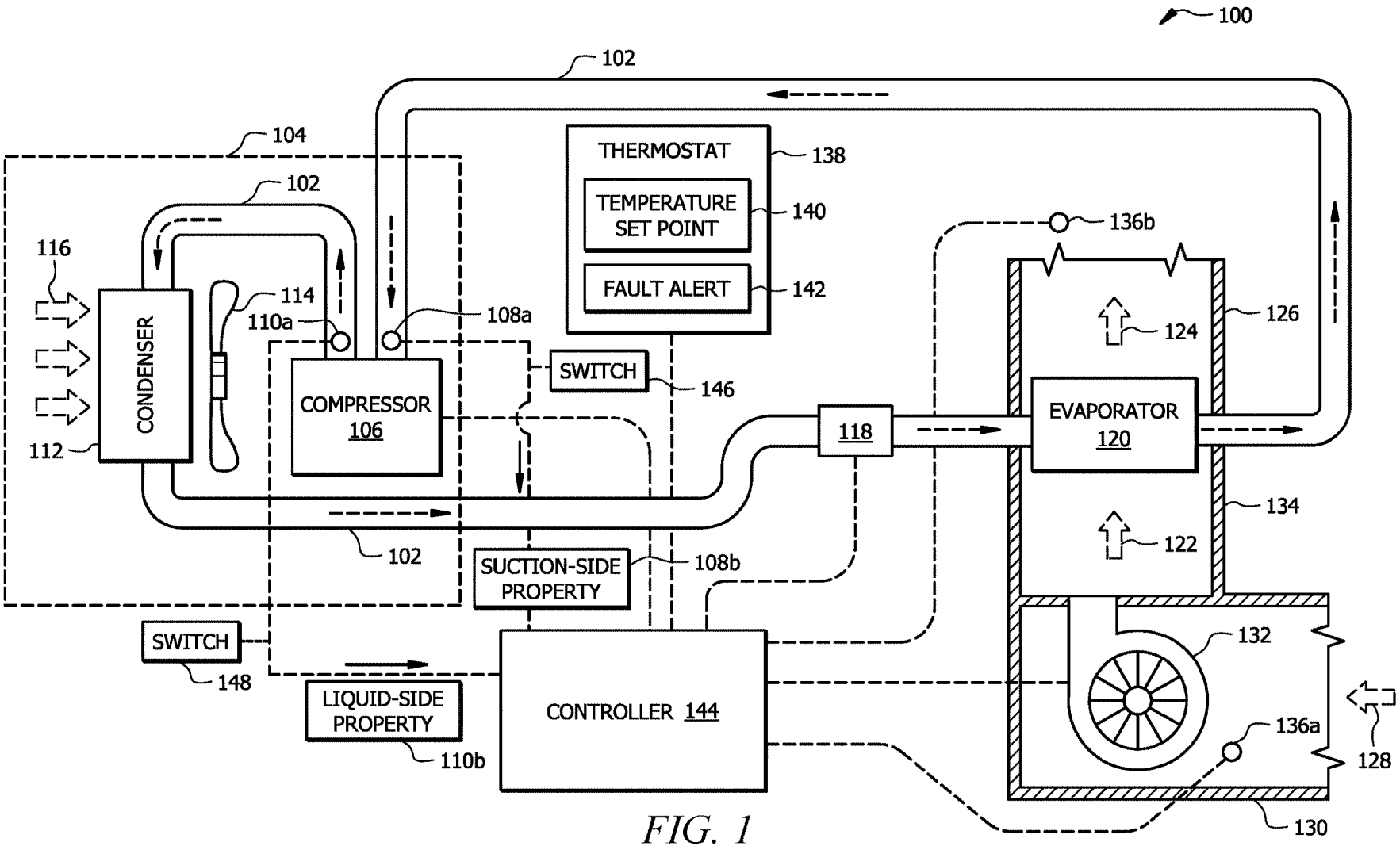
FIG. 1 is a diagram of an example HVAC system configured for system fault prognostic s and/or diagnostics.

FIG. 1 is a diagram of an embodiment of an HVAC system 100 configured for the detection of system faults and the determination of the underlying cause of these faults (e.g., a malfunctioning fan 114, a malfunctioning blower 132, or refrigerant flow blockage). The HVAC system 100 conditions air for delivery to a conditioned space.

The conditioned space may be, for example, a room, a house, an office building, a warehouse, or the like. In some embodiments, the HVAC system 100 is a rooftop unit (RTU) that is positioned on the roof of a building and the conditioned air is delivered to the interior of the building. In other embodiments, portion(s) of the system may be located within the building and portion(s) outside the building. The HVAC system 100 may be configured as shown in FIG. 1 or in any other suitable configuration. For example, the HVAC system 100 may include additional components or may omit one or more components shown in FIG. 1. For instance, in some embodiments, the HVAC system 100 may be configured act as a heat pump by reversing flow of the refrigerant through the system.

The HVAC system 100 includes a refrigerant conduit subsystem 102, a condensing unit 104, an expansion valve 118, an evaporator 120, a thermostat 138, and a controller 144. The HVAC system 100 is configured to determine anticipated system faults (e.g., anticipated trips of the low-pressure shutoff switch 146 and/or the high-pressure shutoff switch 148) by monitoring trends in properties of the HVAC system 100 (e.g., the suction-side property 108*b* and the liquid-side property 110*b*), as described in greater detail below. For instance, trends, over time, of the suction-side property 108*b* and the liquid-side property may be used to diagnose anticipated and already detected faults (see table 200 of FIG. 2A for a summary of trends and/or associated underlying causes of faults).

The refrigerant conduit subsystem 102 facilitates the movement of a refrigerant (e.g., a refrigerant) through a cooling cycle such that the refrigerant flows as illustrated by the dashed arrows in FIG. 1. The refrigerant may be any acceptable refrigerant including, but not limited to, fluorocarbons (e.g. chlorofluorocarbons), ammonia, non-halogenated hydrocarbons (e.g. propane), hydroflurocarbons (e.g. R-410A), or any other suitable type of refrigerant.

The condensing unit 104 includes a compressor 106, a suction-side sensor 108*a*, a liquid-side sensor 110*a*, a condenser 112, and a fan 114. In some embodiments, the condensing unit 104 is an outdoor unit while other components of system 100 may be indoors. The compressor 106 is coupled to the refrigerant conduit subsystem 102 and compresses (i.e., increases the pressure of) the refrigerant. The compressor 106 of condensing unit 104 may be a variable speed or multi-stage compressor. A variable speed compressor is generally configured to operate at different speeds to increase the pressure of the refrigerant to keep the refrigerant moving along the refrigerant conduit subsystem 102. In the variable speed compressor configuration, the speed of compressor 106 can be modified to adjust the cooling capacity of the HVAC system 100. Meanwhile, a multi-stage compressor may include multiple compressors, each configured to operate at a constant speed to increase the pressure of the refrigerant to keep the refrigerant moving along the refrigerant conduit subsystem 102. In the multi-stage compressor configuration, one or more compressors can be turned on or off to adjust the cooling capacity of the HVAC system 100.

The compressor 106 is in signal communication with the controller 144 using a wired or wireless connection. The controller 144 provides commands or signals to control the operation of the compressor 106 and/or receives signals from the compressor 106 corresponding to a status of the compressor 106. For example, when the compressor 106 is a variable speed compressor, the controller 144 may provide a signal to control the compressor speed. When the compressor 106 operates as a multi-stage compressor, the controller 144 may provide an indication of the number of compressors to turn on and off to adjust the compressor 106 for a given cooling capacity. The controller 144 may operate the compressor 106 in different modes corresponding to load conditions (e.g., the amount of cooling or heating required by the HVAC system 100). The controller 144 is described in greater detail below with respect to FIG. 6.

The suction-side sensor 108*a* is generally positioned and configured to measure a suction-side property 108*b* (e.g., a temperature or pressure) associated with refrigerant provided to an inlet of the compressor 106. For example, the suction-side sensor 108*a* may be located in, on, or near the inlet of the compressor 106 to measure properties of the refrigerant flowing into the compressor 106. The suction-side sensor 108*a* is in signal communication with the controller 144 via wired and/or wireless connection and is configured to provide the suction-side property 108*b* to the controller 144, as illustrated in FIG. 1. The suction-side property 108*b* is generally provided as an electronic signal that is interpretable by the controller 144. In some embodiments, the suction-side property 108*b* is a suction-side pressure (i.e., the pressure of refrigerant flowing into the compressor 106). For example, the suction-side sensor 108*a* may provide an indication of the suction-side property 108*b* (e.g., a current or voltage proportional to the measured suction-side property 108*b*) or may provide a signal which may be used by the controller 144 to calculate the suction-side property 108*b*. In some embodiments, the suction-side property 108*b* is a suction-side temperature (i.e., the temperature of refrigerant flowing into the compressor 106). The example of FIG. 1 illustrates the suction-side sensor 108*a* positioned in the refrigerant conduit subsystem 102 proximate to the inlet of the compressor 106. However, it should be understood that the suction-side sensor 108*a* may be positioned in any other appropriate position (e.g., in the inlet of the compressor 106 or further upstream of the inlet of the compressor 106). For instance, in some embodiments, the suction-side sensor 108*a* is located outside of the condensing unit 104 and further upstream (and optionally indoors) in the refrigerant conduit subsystem 102.

The liquid-side sensor 110*a* is generally positioned and configured to measure a liquid-side property 110*b* (e.g., a temperature or pressure) associated with refrigerant provided from an outlet of the compressor 106. For example, the liquid-side sensor 110*a* may be located in, on, or near the outlet of the compressor 106 to measure properties of the refrigerant flowing out of the compressor 106 (e.g., in a compressed, liquid form). The liquid-side sensor 110*a* is in signal communication with the controller 144 via wired and/or wireless connection and is configured to provide the liquid-side property 110*b* to the controller 144, as illustrated in FIG. 1. Similarly to the suction-side property 108*b*, the liquid-side property 110*b* is generally provided as an electronic signal that is interpretable by the controller 144. In some embodiments, the liquid-side property 110*b* is a liquid-side pressure (i.e., the pressure of refrigerant flowing into the compressor 106). For example, the liquid-side sensor 110*a* may provide an indication of the liquid-side property 110*b* (e.g., a current or voltage proportional to the measured liquid-side property 110*b*) or may provide a signal which may be used by the controller 144 to calculate the liquid-side property 110*b*. In some embodiments, the liquid-side property 110*b* is a liquid-side temperature (i.e., the temperature of refrigerant flowing into the compressor 106). The example of FIG. 1 illustrates the liquid-side sensor 110*a* positioned in the refrigerant conduit subsystem 102 proximate to the outlet of the compressor 106. However, it should be understood that the liquid-side sensor 110*a* may be positioned in any other appropriate position (e.g., in the outlet of the compressor 106 or further downstream from the outlet of the compressor 106). For instance, in some embodiments, the liquid-side sensor 110*a* is located nearer the inlet of the condenser 112.

The condenser 112 is configured to facilitate movement of the refrigerant through the refrigerant conduit subsystem 102. The condenser 112 is generally located downstream of the compressor 106 and is configured to remove heat from the refrigerant. The fan 114 is configured to move air 116 across the condenser 112. For example, the fan 114 may be configured to blow outside air through the condenser 112 to assist in cooling the refrigerant flowing therethrough. The fan 114 may in signal communication with the controller 144 via wired and/or wireless communication. For instance, the fan 114 may receive signals from the controller 144 causing the fan to turn on or off based on a cooling need. However, in some embodiments, the fan 114 is not configured to provide any operational information to the controller 144 (i.e., such that the controller 144 is not informed of an operational status or malfunction of the fan 114). The compressed, cooled refrigerant flows from the condenser 112 toward an expansion device 118.

The expansion device 118 is coupled to the refrigerant conduit subsystem 102 downstream of the condenser 112 and is configured to remove pressure from the refrigerant. In this way, the refrigerant is delivered to the evaporator 120 and receives heat from airflow 122 to produce a conditioned airflow 124 that is delivered by a duct subsystem 126 to the conditioned space. In general, the expansion device 118 may be a valve such as an expansion valve or a flow control valve (e.g., a thermostatic expansion valve (TXV) valve) or any other suitable valve for removing pressure from the refrigerant while, optionally, providing control of the rate of flow of the refrigerant. The expansion device 118 may be in communication with the controller 144 (e.g., via wired and/or wireless communication) to receive control signals for opening and/or closing associated valves and/or provide flow measurement signals corresponding to the rate at which refrigerant flows through the refrigerant subsystem 102. However, in some embodiments, the expansion device 118 is not configured to provide any operational information to the controller 144 (i.e., such that the controller 144 is not informed of an operational status or malfunction of the expansion device 118).

The evaporator 120 is generally any heat exchanger configured to provide heat transfer between air flowing through the evaporator 120 (i.e., contacting an outer surface of one or more coils of the evaporator 120) and refrigerant passing through the interior of the evaporator 120. The evaporator 120 is fluidically connected to the compressor 106, such that refrigerant generally flows from the evaporator 120 to the compressor 106. A portion of the HVAC system 100 is configured to move air 122 across the evaporator 120 and out of the duct sub-system 126 as conditioned air 124. Return air 128, which may be air returning from the building, fresh air from outside, or some combination, is pulled into a return duct 130.

The blower 132 pulls the return air 128 and discharges airflow 122 into a duct 134 from where the airflow 122 crosses the evaporator 120 or heating elements (not shown) to produce the conditioned airflow 124. The blower 132 is any mechanism for providing a flow of air through the HVAC system 100. For example, the blower 132 may be a constant-speed or variable-speed circulation blower or fan. Examples of a variable-speed blower include, but are not limited to, belt-drive blowers controlled by inverters, direct-drive blowers with electronic commuted motors (ECM), or any other suitable types of blowers. The blower 132 is in signal communication with the controller 144 using any suitable type of wired or wireless connection. The controller 144 is configured to provide commands or signals to the blower 132 to control its operation. For example, the controller 144 may be configured to signals to the blower 132 to control the speed of the blower 132. In some embodiments, the controller 144 may be configured to receive operational information from the blower 132 (e.g., associated with a status of the blower 132). However, in other embodiments, the blower 132 is not configured to provide operational information to the controller 144 (i.e., such that the controller 144 is not informed of an operational status or a malfunction of the blower 132).

The HVAC system 100 includes one or more sensors 136*a,b* in signal communication with the controller 144. The sensors 136*a,b* may include any suitable type of sensor for measuring air temperature and/or other properties of the conditioned space (e.g. a room or building) and/or the surrounding environment (e.g., outdoors). The sensors 136*a,b* may be positioned anywhere within the conditioned space, the HVAC system 100, and/or the surrounding environment. As an example, the HVAC system 100 may include a sensor 136*a* positioned and configured to measure a return air temperature (e.g., of airflow 128) and/or a sensor 136*b* positioned and configured to measure a supply or treated air temperature (e.g., of airflow 124). As another example, the HVAC system 100 may include a sensor (not shown for clarity and conciseness) positioned and configured to measure an outdoor air temperature and provide this information to the controller 144. In other cases, the HVAC system 100 may include sensors positioned and configured to measure any other suitable type of air temperature and/or other property (e.g., the temperature of air at one or more locations within the conditioned space, e.g., an indoor and/or outdoor humidity).

The HVAC system 100 includes one or more thermostats 138, which may be located within the conditioned space (e.g. a room or building). A thermostat 138 is generally in signal communication with the controller 144 using any suitable type of wired or wireless communication. The thermostat 138 may be a single-stage thermostat, a multi-stage thermostat, or any suitable type of thermostat for the HVAC system 100. The thermostat 138 is configured to allow a user to input a desired temperature or temperature setpoint 140 for a designated space or zone such as a room in the conditioned space. The controller 144 may use information from the thermostat 138 such as the temperature setpoint 140 for controlling the compressor 106, the fan 114, the expansion device 118, and/or the blower 132. In some embodiments, the thermostat 138 includes a user interface for displaying information related to the operation and/or status of the HVAC system 100. For example, the user interface may display operational, diagnostic, and/or status messages and provide a visual interface that allows at least one of an installer, a user, a support entity, and a service provider to perform actions with respect to the HVAC system 100. For example, the user interface may provide for input of the temperature setpoint 140 and display of a fault alert 142 related to any faults anticipated and/or detected by the controller 144 and the determined underlying cause of the fault, as described in greater detail below.

Figures 2A, 2B:
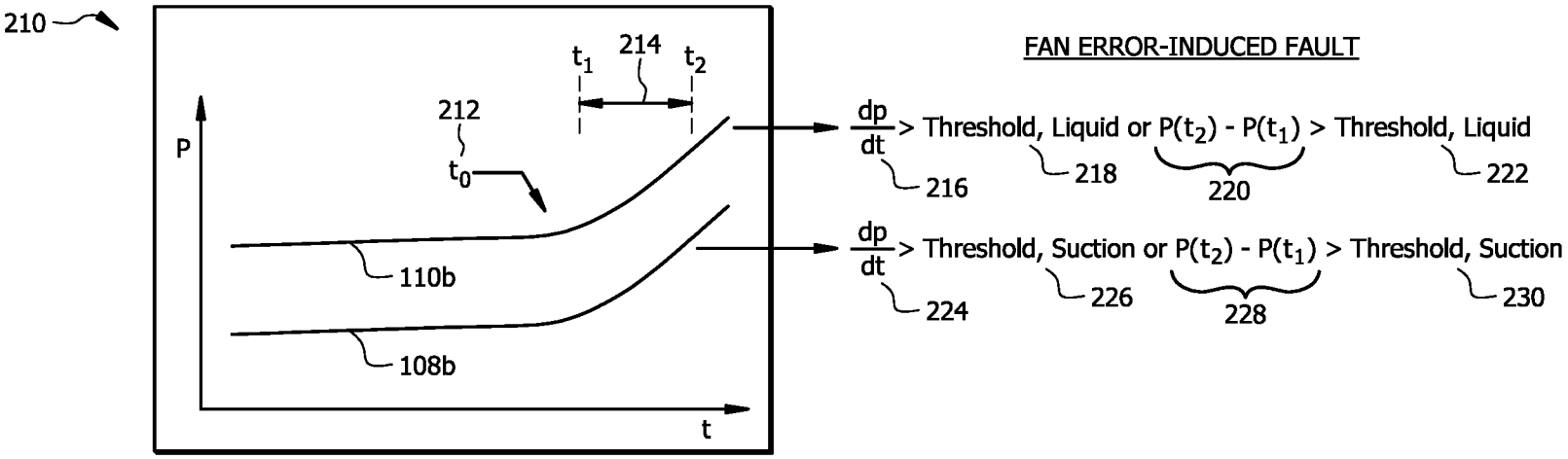
FIG. 2A is a table illustrating trends associated with the prognostics and/or diagnostics of faults of the system of FIG. 1.
FIGS. 2B-2D illustrate examples of approaches to determining the trends shown in the table of FIG. 2A.

As described in greater detail below, the controller 144 is configured to monitor the suction-side property 108*b* and/or the liquid-side property 110*b*, and use this monitored information for system fault prognostics and/or diagnostics. FIG. 2A illustrates the relationship between various trends in properties 108*b*, 110*b* and the associated causes of a system fault. For example, determined trends may be used to determine whether a system fault is anticipated and identify an underlying cause of the anticipated fault (e.g., whether the anticipated fault is associated with a malfunction of the fan 114, a blockage of the refrigerant conduit subsystem 102, or a malfunction of the blower 132), as described in greater detail with respect to FIG. 3 below. As another example, the controller 144 may be configured to determine that the low-pressure shutoff switch 146 has been tripped (e.g., because the suction-side property 108*b* fell below a minimum value) and determine whether the switch 146 was tripped because of a blockage of the refrigerant conduit subsystem 102 or a malfunction of the blower 132, as described in greater detail with respect to FIG. 4 below. As a further example, the controller 144 may be configured to determine that the high-pressure shutoff switch 148 has been tripped (e.g., because the liquid-side property 110*b* exceeded a maximum value) and determine whether the switch 146 was tripped because of a malfunction of the fan 114 or a blockage of the refrigerant conduit subsystem 102, as described in greater detail with respect to FIG. 5 below.

The low-pressure shutoff switch 146 is generally any appropriate device configured to communicate with the suction-side sensor 108*a* and the controller 144 and stop operation of the HVAC system 100 under certain conditions. The low-pressure shutoff switch 146 is generally configured to receive suction-side property 108*b* from the suction-side sensor 108*a*, determine whether the suction-side property 108*b* is less than a minimum value (e.g., a minimum threshold value of the threshold(s) 612 of FIG. 6), and cause the HVAC system 100 to stop operating if the suction-side property 108*b* is less than the minimum value. In other words, if the suction-side property 108*b* is less than the minimum value, the switch 146 is tripped, causing the HVAC system 100 to stop operation. Stopping operation of the HVAC system 100 may include stopping operation of the compressor 106 (e.g., turning the compressor off or adjusting the speed of the compressor 106 to zero hertz), stopping operation of the fan 114, and/or stopping operation of the blower 132. The low-pressure shutoff switch 146 may provide an indication that the switch 146 has been tripped to the controller 144 (e.g., such that the controller 144 may subsequently determine the underlying cause of the trip, as described with respect to FIG. 4 below). While illustrated as a separate device in the example of FIG. 1, functions of the low-pressure shutoff switch 146 may be implemented by the controller 144 (i.e., the controller 144 may include instructions for implementing functions of the low-pressure shutoff switch 146 described above).

The high-pressure shutoff switch 148 is generally any appropriate device configured to communicate with the liquid-side sensor 110*a* and the controller 144 and stop operation of the HVAC system 100 under certain conditions. The high-pressure shutoff switch 148 is generally configured to receive liquid-side property 110*b* from the liquid-side sensor 110*a*, determine whether the liquid-side property 110*b* is greater than a maximum value (e.g., a maximum threshold value of the threshold(s) 612 of FIG. 6), and cause the HVAC system 100 to stop operating if the liquid-side property 110*b* is greater than the maximum value. In other words, if the liquid-side property 110*b* is greater than the maximum value, the switch 148 is tripped, causing the HVAC system 100 to stop operation. Stopping operation of the HVAC system 100 may include stopping operation of the compressor 106 (e.g., turning the compressor off or adjusting the speed of the compressor 106 to zero hertz), stopping operation of the fan 114, and/or stopping operation of the blower 132. The high-pressure shutoff switch 148 may provide an indication that the switch 146 has been tripped to the controller 144 (e.g., such that the controller 144 may subsequently determine the underlying cause of the trip, as described with respect to FIG. 5 below). While illustrated as a separate device in the example of FIG. 1, the high-pressure shutoff switch 148 may be implemented by the controller 144 (i.e., the controller 144 may include instructions for implementing functions of the high-pressure shutoff switch 148 described above).

As described above, in certain embodiments, connections between various components of the HVAC system 100 are wired. For example, conventional cable and contacts may be used to couple the controller 144 to the various components of the HVAC system 100, including, the compressor 106, the suction-side sensor 108*a*, the liquid-side sensor 110*a*, the expansion device 118, the blower 132, sensor(s) 136*a,b*, and thermostat(s) 138. In some embodiments, a wireless connection is employed to provide at least some of the connections between components of the HVAC system 100. In some embodiments, a data bus couples various components of the HVAC system 100 together such that data is communicated therebetween. In a typical embodiment, the data bus may include, for example, any combination of hardware, software embedded in a computer readable medium, or encoded logic incorporated in hardware or otherwise stored (e.g., firmware) to couple components of HVAC system 100 to each other. As an example, and not by way of limitation, the data bus may include an Accelerated Graphics Port (AGP) or other graphics bus, a Controller Area Network (CAN) bus, a front-side bus (FSB), a HYPERTRANSPORT (HT) interconnect, an INFINIBAND interconnect, a low-pin-count (LPC) bus, a memory bus, a Micro Channel Architecture (MCA) bus, a Peripheral Component Interconnect (PCI) bus, a PCI-Express (PCI-X) bus, a serial advanced technology attachment (SATA) bus, a Video Electronics Standards Association local (VLB) bus, or any other suitable bus or a combination of two or more of these. In various embodiments, the data bus may include any number, type, or configuration of data buses, where appropriate. In certain embodiments, one or more data buses (which may each include an address bus and a data bus) may couple the controller 154 to other components of the HVAC system 100.

In an example operation of HVAC system 100, the system 100 starts up to provide cooling to an enclosed space based on temperature setpoint 140. For example, in response to the indoor temperature exceeding the temperature setpoint 140, the controller 144 may cause the compressor 106, the fan 114, and the blower 132 to turn on to "startup" the HVAC system 100. While the HVAC system 100 is cooling the space, the controller 144 may monitor values of the suction-side property 108*b* and the liquid-side property 110*b*. In some embodiments, the controller may wait a predefined delay time (e.g., of about 5 to 15 minutes) before the suction-side property 108*b* and liquid-side property 110*b* are monitored (e.g., to allow the HVAC system to stabilize prior to detecting an anticipated system fault).

Figure 2C:
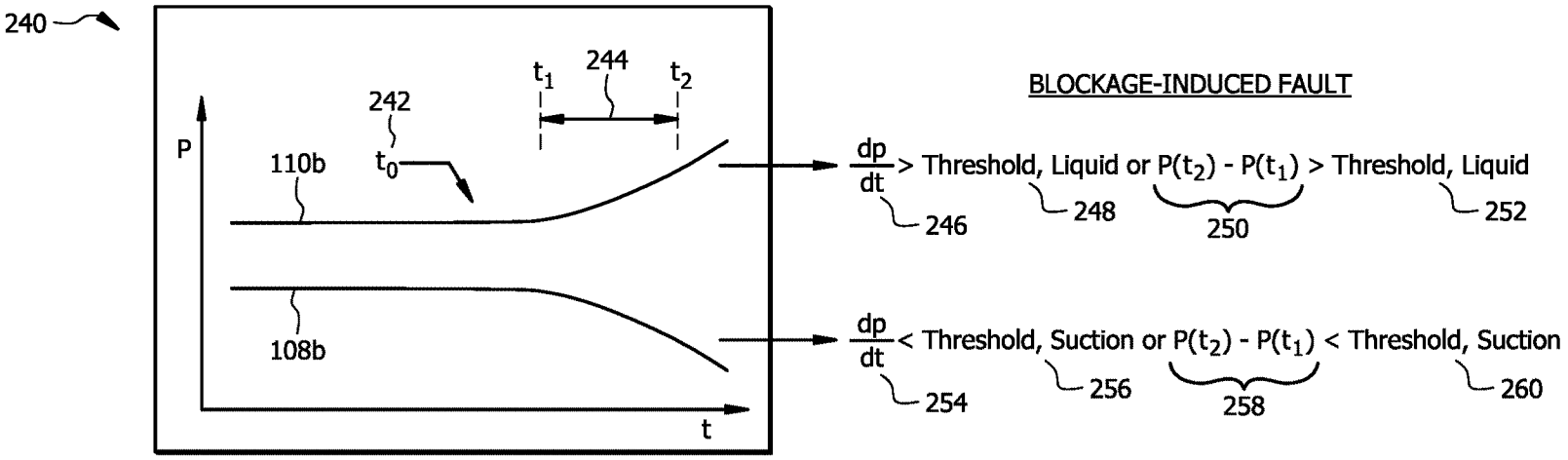
Figure 2D:
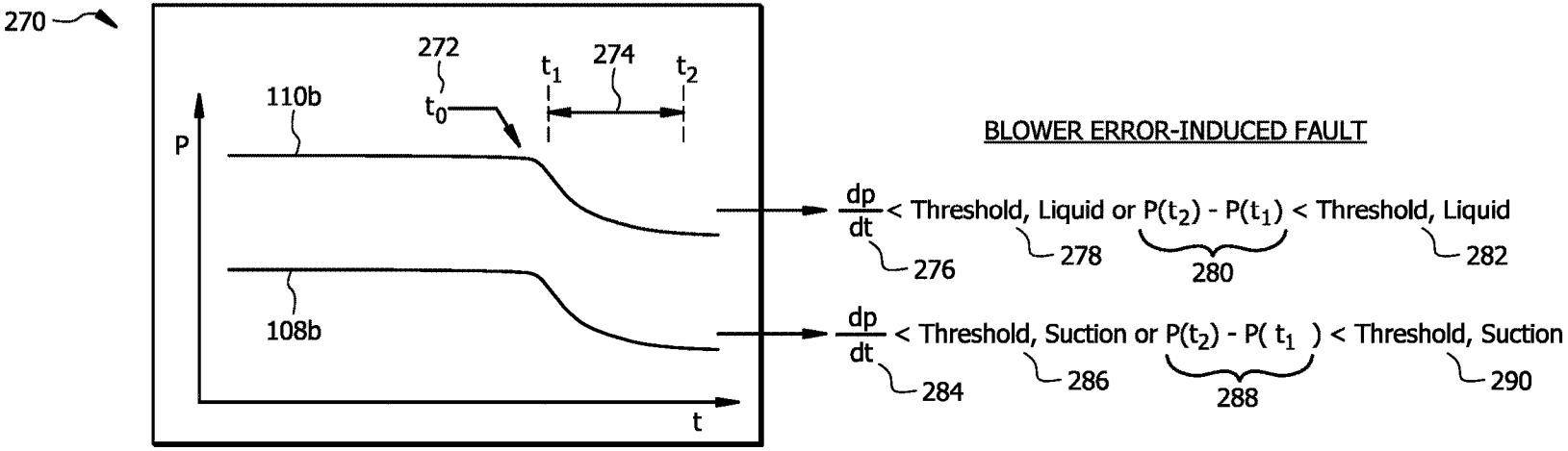

The monitored suction-side property 108*b* and liquid-side property 110*b* may be used to determine whether an anticipated fault (e.g., a likely future fault) or currently occurring fault is detected and identify the underlying cause of the fault. FIGS. 2B-2D illustrate the determination of an anticipated fault related to the various trends identified in table 200 of FIG. 2A. For instance, as illustrated in plot 210 of FIG. 2B, if both the suction-side property 108*b* and the liquid-side property 110*b* display an increasing trend, the controller 144 may detect an anticipated fan error-induced system fault. For example, the controller 144 may determine that the fan 114 is likely experiencing a malfunction (e.g., such that an expected or desired rate of airflow 116 is not being provided). Trends in the suction-side and liquid-side properties 108*b*, 110*b* may be determined, for example, based on a rate of change of the suction-side and liquid-side properties 108*b*, 110*b*, an extent to which the suction-side and liquid-side properties 108*b*, 110*b* change during a predetermined time interval, and/or whether the suction-side and liquid-side properties 108*b*, 110*b* consistently increase or decrease during subintervals of a larger time interval, as described in greater detail below with respect to the examples of FIGS. 2B-2C.

Plot 210 of FIG. 2B shows values of the suction-side property 108*b* and the liquid-side property 110*b* over time for the example case of a malfunction of fan 114. At an initial time (to) 212, the fan 114 stops functioning (i.e., such that airflow 116 of FIG. 1 is no longer provided across the condenser 112). Following the malfunction of the fan 114 at time 212, the values of the suction-side property 108*b* and liquid-side property 110*b* increase.

In order to determine whether the suction-side property 108*b* and the liquid-side property 110*b* are increasing or decreasing, the controller 144 may evaluate changes in the properties 108*b*, 110*b* over a time period 214. In some embodiments, over the time period 214, the controller 144 calculates a rate of change 216 (e.g., a time derivative) of the liquid-side property 110*b*. If the rate of change 216 is positive (i.e., greater than zero) and greater than a threshold value 218, the controller 144 determines that the liquid-side property 110*b* has an increasing trend. In some embodiments, the controller 144 calculates a difference 220 between values of the liquid-side property 110*b* at the end and beginning of the time period 214. In such embodiments, if the difference 220 is positive (i.e., greater than zero) and greater than a threshold value 222, the controller 144 determines that the liquid-side property 110*b* has an increasing trend. In some cases, the controller 144 may determine the difference 220 for at least three sequential subintervals of time period 214, and an increasing trend is only determined if the differences 220 calculated in these sequential subintervals is greater than the threshold value 222. A similar approach may be used to determine whether the suction-side property 108*b* has an increasing trend. For instance, if a rate of change 224 (e.g., time derivative) of the suction-side property 108*b* is greater than a positive threshold 226, the controller 144 may determine that the suction-side property 108*b* is increasing. As another example, if a difference 228 between values of the suction-side property 108*b* at the end and beginning of the time period 214 (e.g., or during at least three sequential subintervals of the time period 214) is greater than a threshold value 230, the controller 144 may determine that the suction-side property 108*b* has an increasing trend.

Following detection of a fan error-induced fault (e.g., as illustrated in FIG. 2B), the controller 144 may cause a fan fault alert 142 to be displayed on an interface of the thermostat 138. In some embodiments, the controller 144 may cause the HVAC system 100 to stop operating (e.g., to stop operation of the compressor 106, fan 114, and blower 132) such that damage to the HVAC system 100 is avoided. In some embodiments, the fan fault alert 142 may be provided to a third-party (e.g., an administrator or maintenance provider of the HVAC system 100). This may provide for more rapid correction of the possible malfunction of the fan 114. In some cases, the advanced detection of an anticipated malfunction may allow appropriate corrective action to be taken (e.g., repair or replacement of the fan 114), before a more catastrophic failure of the malfunctioning device or the HVAC system 100 occurs. Thus, the HVAC system 100 may be able to provide continued air conditioning with fewer down times during which air conditioning is not possible.

As another example illustrated in table 200 of FIG. 2A, if the suction-side property 108*b* has a decreasing trend and the liquid-side property has an increasing trend, the controller 144 may detect an anticipated fault associated with a blockage of refrigerant flow in the refrigerant conduit subsystem 102. Such a fault may be associated with a malfunction of the expansion device 118 and/or the accumulation of debris in the conduit subsystem 102.

FIG. 2C shows a plot 240 of values of the suction-side property 108*b* and the liquid-side property 110*b* over time for the example case of a blockage of the refrigerant conduit subsystem 102. At an initial time (to) 242, the blockage of the conduit subsystem 102 occurs (e.g., debris blocks flow of refrigerant through the conduit subsystem 102, the expansion device 118 closes or malfunctions, or the like). Following the blockage of the refrigerant conduit subsystem 102 at time 242, the values of the suction-side property 108*b* decrease and values of the liquid-side property 110*b* increase, as illustrated in plot 240.

Similarly to as described above with respect to FIG. 2B, in order to determine whether the suction-side property 108*b* and the liquid-side property 110*b* are increasing or decreasing, the controller 144 may evaluate changes in the properties 108*b*, 110*b* over a time period 244. For instance, if a rate of change 246 (e.g., time derivative) of the liquid-side property 110*b* determined over the time period 244 (e.g., or a portion of the time period 244) is greater than a positive threshold 248, the controller 144 may determine that the liquid-side property 110*b* has an increasing trend. As another example, if a difference 250 between values of the liquid-side property 110*b* at the end and beginning of the time period 244 (e.g., or during at least three sequential subintervals of the time period 244) is greater than a threshold value 252, the controller 144 may determine that the liquid-side property 110*b* has an increasing trend. Likewise, if a rate of change 254 (e.g., time derivative) of the suction-side property 108*b* determined over the time period 244 (e.g., or a portion of the time period 244) is less than a negative threshold 256, the controller 144 may determine that the suction-side property 108*b* has a decreasing trend. As another example, if a difference 258 between values of the suction-side property 108*b* at the end and beginning of the time period 244 (e.g., or during at least three sequential subintervals of the time period 244) is less than a negative threshold value 260, the controller 144 may determine that the suction-side property 108*b* has a decreasing trend. The negative thresholds 256, 260 are threshold values (e.g., thresholds 612 of FIG. 6) that are less than zero.

In this example case of an anticipated blockage of refrigerant in the conduit subsystem 102, the controller 144 may cause a refrigerant blockage-related fault alert 142 to be displayed on an interface of the thermostat 138 and/or be provided to a third party for proactive correction. In some embodiments, the controller 144 may attempt to open the expansion device 118 further and determine whether this corrects the fault (i.e., determine whether the trends associated with this fault are no longer observed). If the fault is no longer detected, the alert 142 may be rescinded. However, if the trend remains, the alert 142 may be maintained, and, in some cases, operation of the HVAC system 100 (i.e., of the compressor 106, the fan 116, and the blower 132) may be stopped to prevent damage to the HVAC system 100.

As another example illustrated in table 200 of FIG. 2A, if both the suction-side property 108*b* and the liquid-side property 110*b* have a decreasing trend, the controller 144 may detect an anticipated fault associated with a malfunction of the blower 132. For instance, the blower 132 may provide a lower than expected airflow 122 across the evaporator 120. In this example case of an anticipated malfunction of the blower 132, the controller 144 may cause operation of the HVAC system 100 (i.e., of the compressor 106, the fan 116, and the blower 132) to be stopped in order to prevent damage to the HVAC system 100.

FIG. 2D shows a plot 270 of values of the suction-side property 108*b* and the liquid-side property 110*b* over time for the example case of a malfunction of the blower 132 At an initial time ($t_0$) 272, the malfunction of the blower 132 occurs (e.g., such that airflow 122 is not provided as expected). Following the malfunction of the blower 132 at time 272, the values of the suction-side property 108*b* and the liquid-side property 110*b* decrease, as illustrated in plot 270.

Similar to as described above with respect to FIGS. 2B and 2C, in order to determine whether the suction-side property 108*b* and the liquid-side property 110*b* are increasing or decreasing, the controller 144 may evaluate changes in the properties 108*b*, 110*b* over a time period 274. For instance, if a rate of change 276 (e.g., time derivative) of the liquid-side property 110*b* determined over the time period 274 (e.g., or a portion of the time period 274) is less than a negative threshold 278, the controller 144 may determine that the liquid-side property 110*b* has a decreasing trend. As another example, if a difference 280 between values of the liquid-side property 110*b* at the end and beginning of the time period 274 (e.g., or during at least three sequential subintervals of the time period 274) is less than a negative threshold value 282, the controller 144 may determine that the liquid-side property 110*b* has a decreasing trend. Likewise, if a rate of change 284 (e.g., time derivative) of the suction-side property 108*b* determined over the time period 274 (e.g., or a portion of the time period 274) is less than a negative threshold 286, the controller 144 may determine that the suction-side property 108*b* has a decreasing trend. As another example, if a difference 288 between values of the suction-side property 108*b* at the end and beginning of the time period 274 (e.g., or during at least three sequential subintervals of the time period 274) is less than a negative threshold value 290, the controller 144 may determine that the suction-side property 108*b* has a decreasing trend. The negative thresholds 278, 282, 286, 290 are threshold values (e.g., thresholds 612 of FIG. 6) that are less than zero.

Further details of the determination of an anticipated fault and the identification of an underlying cause of the fault (e.g., whether the anticipated fault is associated with a malfunction of fan 114, a blockage of the conduit subsystem 102, or a malfunction of the blower 132) are described below with respect to FIG. 3.

As another example of the operation of the system 100, the low-pressure shutoff switch 146 may be tripped because the suction-side property 108*b* fell below a minimum value (e.g., a threshold of threshold(s) 612 described in FIG. 6 below). When the switch 146 is tripped, the HVAC system 100 generally stops operating (e.g., the compressor 106, fan 114, and blower 132 shut off). The controller 144 may use previously monitored values of the liquid-side property 110*b* (i.e., values obtained before switch 146 was tripped) to determine whether the fault associated with tripping switch 146 was caused by a blockage of the refrigerant conduit subsystem 102 or a malfunction of the blower 132.

As illustrated in table 200 of FIG. 2A, an increasing trend in the liquid-side property 110*b* following a trip of the low-pressure shutoff switch 146, corresponds to detection of a fault associated with a blockage of conduit subsystem 102. Meanwhile, a decreasing trend in the liquid-side property 110*b* following a trip of the low-pressure switch 146, corresponds to detection of a fault associated with a malfunction of the blower 132. Trends in the property values 108*b*, 110*b* may be determined as described above with respect to FIGS. 2B-2D. The alert 142 presented on an interface of the thermostat 138 for this example case may include an indication that the low-pressure shutoff switch 146 was tripped and an indication of the determined cause of the fault (i.e., whether caused by blockage of conduit subsystem 102 or malfunction of the blower 132). Further details of the determination of the cause of system fault following the tripping of low-pressure shutoff switch 146 are described below with respect to FIG. 4.

As yet another example of the operation of the HVAC system 100, the high-pressure shutoff switch 148 may be tripped because the liquid-side property 110*b* increases above a maximum value (e.g., a threshold of threshold(s) 612 described in FIG. 6 below). When the switch 148 is tripped, the HVAC system 100 generally stops operating (e.g., the compressor 106, fan 114, and blower 132 shut off). The controller 144 may use previously monitored values of the suction-side property 108*b* (i.e., values obtained before switch 148 was tripped) to determine whether the fault associated with the tripping of switch 148 was caused by a malfunction of the fan 114 or a blockage of the refrigerant conduit subsystem 102.

As illustrated in table 200 of FIG. 2A, an increasing trend in the suction-side property 108*b* following a trip of the high-pressure switch 148, corresponds to detection of a fault associated with a malfunction of the fan 114. Meanwhile, a decreasing trend in the suction-side property 108*b* following a trip of the high-pressure switch 148, corresponds to detection of a fault associated with a blockage of conduit subsystem 102. Trends in the property values 108*b*, 110*b* may be determined as described above with respect to FIGS. 2B-2D. The alert 142 presented on an interface of the thermostat 138 for this example case may include an indication that the high-pressure shutoff switch 148 was tripped and an indication of the determined cause of the fault (i.e., whether caused by malfunction of fan 114 or blockage of conduit subsystem 102). Further details of the determination of the cause of system fault following the tripping of high-pressure shutoff switch 148 are described below with respect to FIG. 5.

Trend-Based Prognostics and Diagnostics

Figure 3:
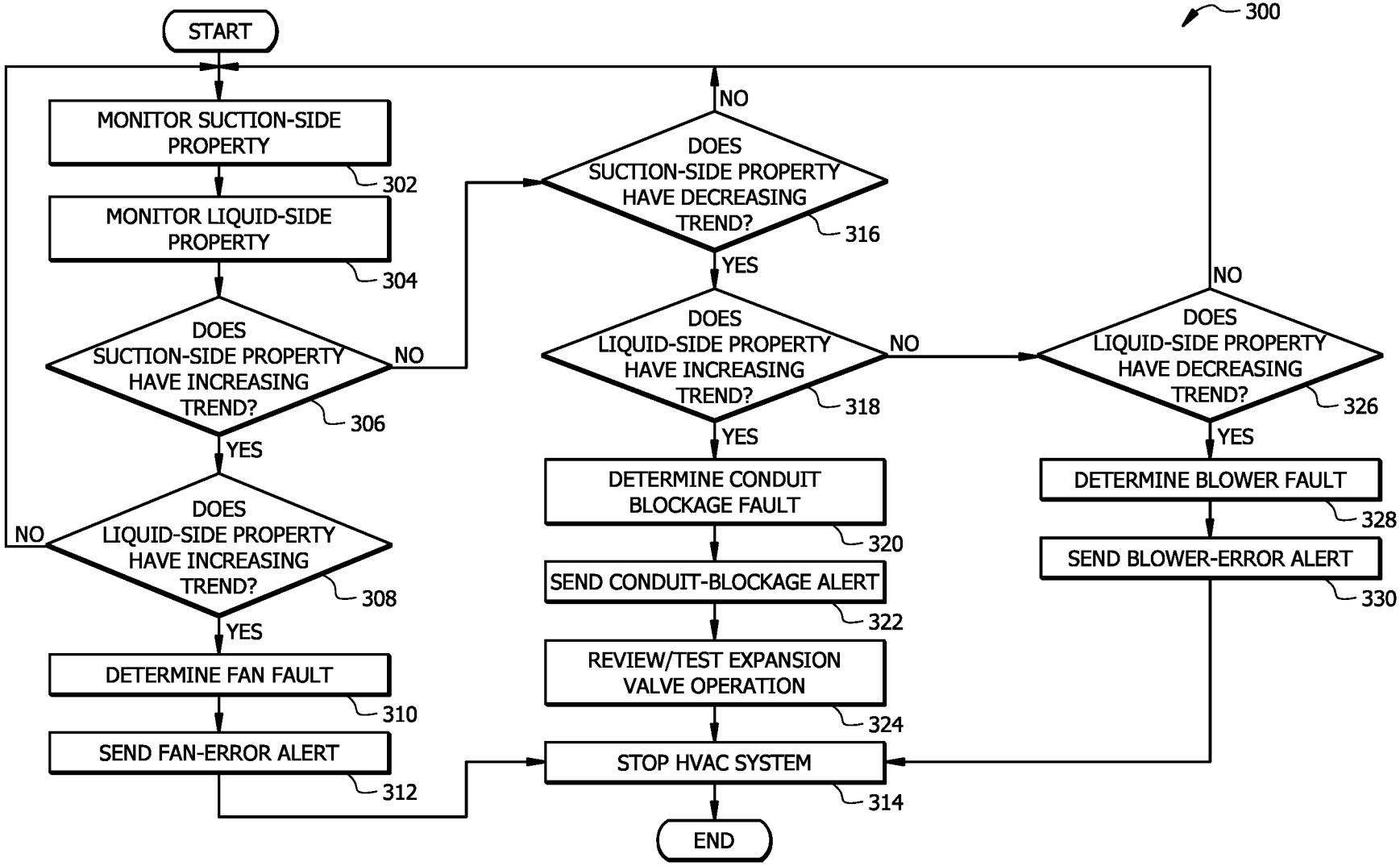
FIG. 3 is a flowchart illustrating an example method of operating the HVAC system of FIG. 1 for system fault prognostics and diagnostics.

FIG. 3 is a flowchart of an example method 300 of operating the HVAC system 100 of FIG. 1 for system prognostics and diagnostics. The method 300 generally facilitates the determination of an anticipated system fault and the identification of the underlying cause of the fault, based on trends in the suction-side property 108*b* and liquid-side property 110*b* over time. At step 302, the suction-side property 108*a* is monitored by the controller 144 over time. For example, the controller 144 may receive the suction-side property 108*b* from the suction-side sensor 108*a* intermittently (e.g., several times per second, each second, or the like) and store the suction-side property 108*b* measurements (e.g., as measurements 608 of FIG. 6, described below). At step 304, the liquid-side property 110*a* is monitored by the controller 144 over time. For example, the controller 144 may receive the liquid-side property 110*b* from the liquid-side sensor 110*a* intermittently and store the liquid-side property 110*b* measurements (e.g., as measurements 610 of FIG. 6, described below).

At step 306, the controller 144 determines whether the suction-side property 108*b* has an increasing trend. The controller 144 determines whether the suction-side property 108*b* generally increases or decreases in value over a period of time, as illustrated in the examples of FIGS. 2A-2D described above. In some embodiments, a trend in the suction-side property 108*b* is determined based on a rate of change of the suction-side property 108*b* (e.g., a time derivative of stored values and/or instantaneous values of the suction-side property 108*b*). For example, the controller 144 may determine a rate of change of the suction-side property 108*b* over a period of time. For example, several values of the rate of change may be determined over time. The controller 144 may determine if the rate of change is positive (i.e., greater than zero) for a predefined period of time (e.g., for 30 seconds or more). In some embodiments, if the rate of change has been positive for the period of time, the controller 144 may determine that the suction-side property 108*b* has an increasing trend at step 306. In some embodiments, in order to determine that the suction-side property 108*b* has an increasing trend, the controller 144 may determine that the rate of change of the suction-side property 108*b* is both positive and greater than a threshold value for a minimum period of time. In some embodiments, in order for a trend to be established (e.g., based on a rate of change or a difference, as described above), the trend must be consistent over a minimum number of sequential time subintervals as described, for example, with respect to FIG. 2B above. In some embodiments, the controller 144 may also determine that the compressor speed and outdoor temperature are not varying (e.g., not changing by more than a corresponding threshold amount), before determining a trend in the suction-side property 108*b*. For example, if one or both of the compressor speed and the outdoor temperature vary by more than a corresponding threshold amount, the controller 144 may end method 300.

If, at step 306, the controller 144 determines that the suction-side property has an increasing trend, the controller 144 proceeds to step 308 to determine whether the liquid-side property 110*b* has an increasing trend. Whether the liquid-side property 110*b* has an increasing trend may be determined as described above with respect to FIG. 2B. If the liquid-side property 110*b* is not determined to have an increasing trend, the controller 144 may return to monitoring the suction-side property 108*b* and liquid-side property 110*b* at steps 302 and 304.

Otherwise, if the suction-side property 108*b* is determined to have an increasing trend at step 306 and the liquid-side property 110*b* is determined to have an increasing trend at step 308, the controller 144 determines that a fault is anticipated related to a malfunction of the fan 114 (see also the second row of table 200 of FIG. 2A). This disclosure encompasses the recognition that conditions resulting to an increasing trend in the suction-side property 108*b* and the liquid-side property 110*b* may be associated with a malfunction of the fan 114 (e.g., and an inadequate supply of airflow 116 across the condenser 112). At step 312, an alert 142 may be provided indicating the anticipated malfunction of the fan 114. This alert 142 may be provided for display on an interface of the thermostat 138 and/or to a third party (e.g., a maintenance provider or administrator of the HVAC system 100), as described above with respect to FIG. 1.

At step 314, the controller 144 may stop operation of the HVAC system 100 (e.g., stop operation of the compressor 106, the fan 114, and the blower 132). Stopping operation of the HVAC system 100 may prevent damage to the HVAC system 100 caused by a malfunction of the fan 114. In some embodiments, the HVAC system 100 may be allowed to operate briefly after a fan malfunction is determined at step 310 (e.g., to ascertain whether the trends determined at steps 306 and 308 are maintained). However, in other embodiments, the HVAC system may be shut down at step 314 without delay following determination of a fan fault at step 310. This disclosure encompasses the recognition that a malfunction of fan 114 may lead to a relatively rapid decrease in system performance, such that operation of the HVAC system 100 should be stopped rapidly after determination of the fan-related fault at step 310 to prevent damage to the HVAC system 100.

If, at step 306, the suction-side property 108*b* is not determined to have an increasing trend, the controller 144 determines whether the suction-side property 108*b* has a decreasing trend at step 316. Whether the suction-side property 108*b* has an increasing trend may be determined, for example, as described above with respect to FIG. 2B (e.g., based on a rate of change of the suction-side property 108*b* or a difference of values of the suction-side property 108*b* between the end and start of a predefined period of time).

If the suction-side property 108*b* does not have a decreasing trend at step 316, the controller 144 may return to monitoring the suction-side property 108*b* and liquid-side property 110*b* at steps 302 and 304. Otherwise, if the controller 144 determines that the suction-side property has a decreasing trend at step 316, the controller 144 proceeds to determine whether the liquid-side property 110*b* has an increasing trend at step 318. The determination at step 318 may be performed as explained above with respect to step 308.

If the suction-side property 108*b* is determined to have a decreasing trend at step 316 and the liquid-side property 110*b* is determined to have an increasing trend at step 318, the controller determines, at step 320, that a fault related to blockage of the conduit subsystem 102 is anticipated (see also the third row of table 200 of FIG. 2A). At step 322, the controller 144 may provide an alert 142 indicating the anticipated blockage of the conduit subsystem 102 determined at step 320. This alert 142 may be provided for display on an interface of the thermostat 138 and/or to a third party (e.g., a maintenance provider or administrator of the HVAC system 100), as described above with respect to FIG. 1.

At step 324, the controller 144 may, optionally, test operation of the expansion device 118 to ascertain whether the blockage of the conduit subsystem 102 can be compensated for and/or corrected. For example, the controller 144 may send a signal instructing the expansion device 118 to open further and determine whether, following sending this signal, the trends determined at steps 316 and 318 are maintained. If the trends remain, the controller 144 may stop operation of the HVAC system 100 (e.g., stop operation of the compressor 106, the fan 114, and the blower 132). Stopping operation of the HVAC system 100 may prevent damage to the HVAC system 100 caused by a blockage of refrigerant flow in the conduit subsystem 102. If the test at step 324 indicates that conduit subsystem 102 blockage was corrected (e.g., if trends at steps 316 and 318 are no longer determined), the controller 144 may allow the HVAC system 100 to continue operating (e.g., providing heating or cooling) for at least a brief period of time. This may allow continued comfort for individuals during a time before maintenance to the conduit subsystem 102 is performed.

If at step 318, the controller 144 does not determine that the liquid-side property 110*b* has an increasing trend, the controller may proceed to step 326 to determine whether the liquid-side property has a decreasing trend. For example, the controller 144 may determine whether the suction-side property 110*b* has a decreasing trend based on a rate of change of the liquid-side property 110*b* or a difference of values of the liquid-side property 110*b* between the end and start of a predefined period of time. Whether the liquid-side property 110*b* has a decreasing trend may be determined as described above with respect to FIG. 2D.

If the controller 144 determines, at step 326, that the liquid-side property 110*b* does not have a decreasing trend, the controller 144 may return to monitoring the suction-side property 108*b* and liquid-side property 110*b* at steps 302 and 304. Otherwise, if the controller 144 determines that the suction-side property 108*b* and the liquid-side property 110*b* have a decreasing trend, the controller 144 may determine that a fault associated with a malfunction of the blower 132 is anticipated (see the fourth row of table 200 of FIG. 2A). At step 330, the controller 144 may provide an alert 142 indicating the anticipated blower fault determined at step 328. This alert 142 may be provided for display on an interface of the thermostat 138 and/or to a third party (e.g., a maintenance provider or administrator of the HVAC system 100), as described above with respect to FIG. 1. At step 314, the controller 144 may stop operation of the HVAC system 100 (e.g., stop operation of the compressor 106, the fan 114, and the blower 132). Stopping operation of the HVAC system 100 may prevent damage to the HVAC system 100 caused by malfunction of the blower 132.

Modifications, additions, or omissions may be made to method 300 depicted in FIG. 3. Method 300 may include more, fewer, or other steps. For example, steps may be performed in parallel or in any suitable order. While at times discussed as controller 144, HVAC system 100, or components thereof performing steps, any suitable HVAC system or components of the HVAC system 100 may perform one or more steps of the method 300.

Diagnostics Following a Low-Pressure Switch Trip

Figure 4:
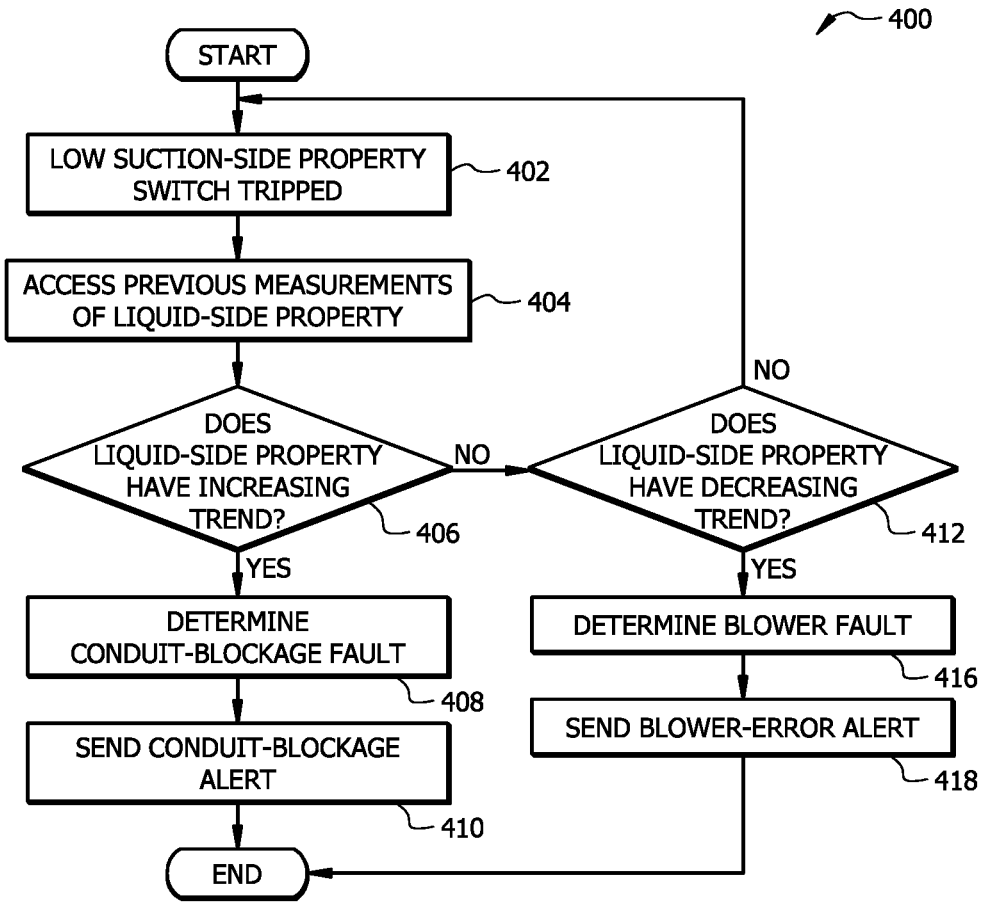
FIG. 4 is a flowchart illustrating an example method of operating the HVAC system of FIG. 1 for system fault diagnostics after a shutoff switch associated with a low suction property value is tripped.

FIG. 4 is a flowchart of an example method 400 of operating the HVAC system 100 of FIG. 1 for automatically diagnosing the cause of a trip of the low-pressure shutoff switch 146. The method 400 generally facilitates the determination (e.g., the automatic determination) of the underlying cause of the low-pressure shutoff switch 146 being tripped. At step 402, the low-pressure shutoff switch 146 is tripped. The low-pressure shutoff switch 146 may be tripped if the suction-side property 108*b* is less than a minimum value, as described above with respect to FIG. 1. Tripping of the low-pressure shutoff switch 146 generally causes the HVAC system to stop operating (e.g., for the compressor 106, fan 114, and blower 132 to shut off). At step 404, the controller 144 accesses previously measured values of the liquid-side property 110*a* (e.g., measurements 610 of FIG. 6, described below).

At step 406, the controller 144 determines whether the liquid-side property 110*b* had an increasing trend prior to when the switch 146 was tripped. The controller 144 determines whether the liquid-side property 110*b* generally increases in value over a period of time, as illustrated in the example of FIG. 2B described above. In some embodiments, a trend in the suction-side property 108*b* is determined based on a rate of change of the liquid-side property 110*b* (e.g., a time derivative of stored values of the liquid-side property 110*b*). For example, the controller 144 may determine a rate of change of the liquid-side property 110*b* over a period of time. For example, several values of the rate of change may be determined over time. The controller 144 may determine if the values of the rate of change are positive (i.e., greater than zero) for a predefined period of time (e.g., for 30 seconds or more). In some embodiments, if the rate of change has been positive for the period of time, the controller 144 may determine that the liquid-side property 110*b* has an increasing trend at step 406. In some embodiments, in order to determine that the liquid-side property 110*b* has an increasing trend, the controller 144 may determine that the rate of change of the liquid-side property 110*b* is both positive and greater than a threshold value for a minimum period of time. In some embodiments, in order for a trend to be established (e.g., based on a rate of change or a difference, as described above), the trend must be consistent over a minimum number of sequential time subintervals as described with respect to FIG. 2B above.

If the liquid-side property 110*b* had an increasing trend, the controller 144 determines, at step 408, that the system fault (e.g., leading to tripping of the switch 146) was caused by a blockage of the refrigerant conduit subsystem 102. At step 410, the controller 144 may provide an alert 142 indicating that the switch 146 was likely tripped because of a blockage of the refrigerant conduit subsystem 102. This alert 142 may be provided for display on an interface of the thermostat 138 and/or to a third party (e.g., a maintenance provider or administrator of the HVAC system 100), as described above with respect to FIG. 1.

If the liquid-side property 110*b* had an increasing trend, the controller 144 determines, at step 412, whether the liquid-side property 110*b* had a decreasing trend prior to when the switch 146 was tripped. The controller 144 determines whether the liquid-side property 110*b* generally decreases in value over a period of time, as illustrated in the example of FIG. 2D described above. In some embodiments, a trend in the suction-side property 108*b* is determined based on a rate of change of the liquid-side property 110*b* (e.g., a time derivative of stored values of the liquid-side property 110*b*). For example, the controller 144 may determine a rate of change of the liquid-side property 110*b* over a period of time. For example, several values of the rate of change may be determined over time. The controller 144 may determine if the values of the rate of change are negative (i.e., less than zero) for a predefined period of time (e.g., for 30 seconds or more). In some embodiments, if the rate of change has been negative for the period of time, the controller 144 may determine that the liquid-side property 110*b* has a decreasing trend at step 412. In some embodiments, in order to determine that the liquid-side property 110*b* has a decreasing trend, the controller 144 may determine that the rate of change of the liquid-side property 110*b* is both negative and less than a threshold value for a minimum period of time. In some embodiments, in order for a trend to be established (e.g., based on a rate of change or a difference, as described above), the trend must be consistent over a minimum number of sequential time subintervals as described with respect to FIG. 2B above.

If the liquid-side property 110*b* had a decreasing trend, the controller 144 determines, at step 414, that the system fault (e.g., leading to tripping of the switch 146) was caused by a malfunction of the blower 132. At step 416, the controller 144 provides an alert 142 indicating the tripping of the switch 146 is likely related to a malfunction of the blower 132. This alert 142 may be provided for display on an interface of the thermostat 138 and/or to a third party (e.g., a maintenance provider or administrator of the HVAC system 100), as described above with respect to FIG. 1.

Modifications, additions, or omissions may be made to method 400 depicted in FIG. 4. Method 400 may include more, fewer, or other steps. For example, steps may be performed in parallel or in any suitable order. While at times discussed as controller 144, HVAC system 100, or components thereof performing steps, any suitable HVAC system or components of the HVAC system 100 may perform one or more steps of the method 400.

Diagnostics Following a High-Pressure Switch Trip

Figure 5:
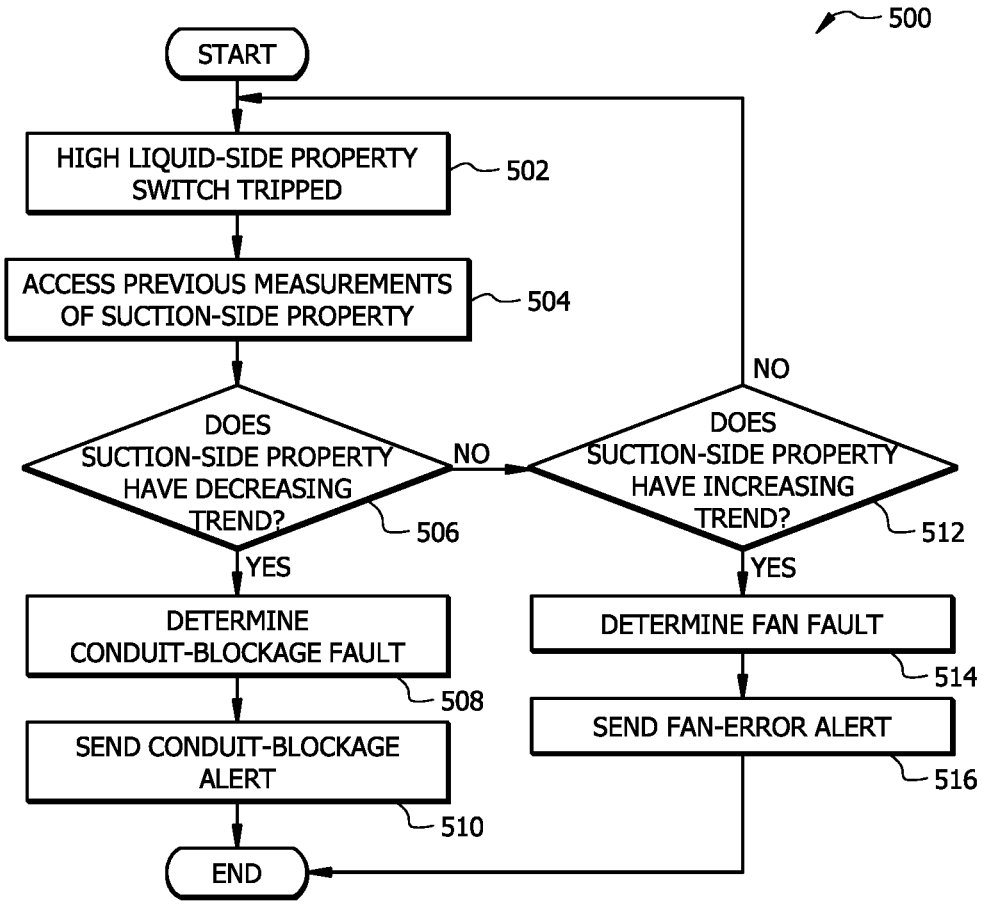
FIG. 5 is a flowchart illustrating an example method of operating the HVAC system of FIG. 1 for system fault diagnostics following after a shutoff switch associated with a high suction property value is tripped.

FIG. 5 is a flowchart of an example method 500 of operating the HVAC system 100 of FIG. 1 for automatically diagnosing the cause of a trip of the high-pressure shutoff switch 148. The method 500 generally facilitates the determination (e.g., the automatic determination) of the underlying cause of the high-pressure shutoff switch 148 being tripped. At step 502, the high-pressure shutoff switch 148 is tripped. The high-pressure shutoff switch 148 may be tripped if the liquid-side property 110*b* is greater than a maximum value, as described above with respect to FIG. 1. Tripping of the high-pressure shutoff switch 148 generally causes the HVAC system 100 to stop operating (e.g., for the compressor 106, fan 114, and blower 132 to shut off). At step 504, the controller 144 accesses previously measured values of the suction-side property 108*b* (e.g., measurements 608 of FIG. 6, described below).

At step 506, the controller 144 determines whether the suction-side property 108*b* had a decreasing trend prior to when the switch 148 was tripped. The controller 144 determines whether the suction-side property 108*b* generally decreases in value over a period of time, as illustrated in the example of FIG. 2D described above. In some embodiments, a trend in the suction-side property 108*b* is determined based on a rate of change of the suction-side property 108*b* (e.g., a time derivative of stored values of the suction-side property 108*b*). For example, the controller 144 may determine a rate of change of the suction-side property 108*b* over a period of time. For example, several values of the rate of change may be determined over time. The controller 144 may determine if the values of the rate of change are negative (i.e., less than zero) for a predefined period of time (e.g., for 30 seconds or more). In some embodiments, if the rate of change has been negative for the period of time, the controller 144 may determine that the suction-side property 108*b* has a decreasing trend at step 506. In some embodiments, in order to determine that the suction-side property 108*b* has a decreasing trend, the controller 144 may determine that the rate of change of the suction-side property 108*b* is both negative and less than a threshold value for a minimum period of time. In some embodiments, in order for a trend to be established (e.g., based on a rate of change or a difference, as described above), the trend must be consistent over a minimum number of sequential time subintervals as described with respect to FIG. 2B above.

If the suction-side property 108*b* had a decreasing trend at step 506, the controller 144 determines, at step 508, that the system fault (e.g., leading to tripping of the switch 148) was caused by a blockage of the refrigerant conduit subsystem 102. At step 510, the controller 144 may provide an alert 142 indicating that the switch 148 was likely tripped because of a blockage of the refrigerant conduit subsystem 102. This alert 142 may be provided for display on an interface of the thermostat 138 and/or to a third party (e.g., a maintenance provider or administrator of the HVAC system 100), as described above with respect to FIG. 1.

If the suction-side property 108*b* did not have a decreasing trend at step 506, the controller 144 determines, at step 512, whether the suction-side property 108*b* had an increasing trend prior to when the switch 148 was tripped. The controller 144 determines whether the suction-side property 108*b* generally increases in value over a period of time, as illustrated in the example of FIG. 2B described above. In some embodiments, a trend in the suction-side property 108*b* is determined based on a rate of change of the suction-side property 108*b* (e.g., a time derivative of stored values of the suction-side property 108*b*). For example, the controller 144 may determine a rate of change of the suction-side property 108*b* over a period of time. For example, several values of the rate of change may be determined over time. The controller 144 may determine if the values of the rate of change are positive (i.e., greater than zero) for a predefined period of time (e.g., for 30 seconds or more). In some embodiments, if the rate of change has been positive for the period of time, the controller 144 may determine that the suction-side property 108*b* has an increasing trend at step 512. In some embodiments, in order to determine that the suction-side property 108*b* has an increasing trend, the controller 144 may determine that the rate of change of the suction-side property 108*b* is both positive and greater than a threshold value for a minimum period of time. In some embodiments, in order for a trend to be established (e.g., based on a rate of change or a difference, as described above), the trend must be consistent over a minimum number of sequential time subintervals as described with respect to FIG. 2B above.

If the suction-side property 108*b* had an increasing trend at step 512, the controller 144 determines, at step 514, that the system fault (e.g., leading to tripping of the switch 148) was caused by a malfunction of the fan 114. At step 516, the controller 144 provides an alert 142 indicating the tripping of the switch 148 is likely related to a malfunction of the blower 132. This alert 142 may be provided for display on an interface of the thermostat 138 and/or to a third party (e.g., a maintenance provider or administrator of the HVAC system 100), as described above with respect to FIG. 1.

Modifications, additions, or omissions may be made to method 500 depicted in FIG. 5. Method 500 may include more, fewer, or other steps. For example, steps may be performed in parallel or in any suitable order. While at times discussed as controller 144, HVAC system 100, or components thereof performing steps, any suitable HVAC system or components of the HVAC system 100 may perform one or more steps of the method 500.

Example Controller

Figure 6:
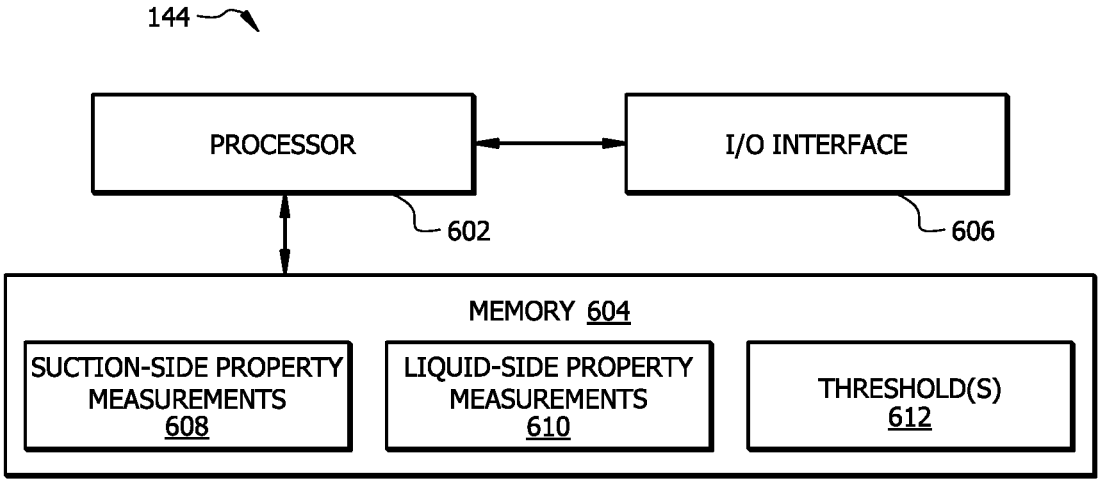
FIG. 6 is a diagram of the controller of the example HVAC system of FIG. 1.

FIG. 6 is a schematic diagram of an embodiment of the controller 144. The controller 144 includes a processor 602, a memory 604, and an input/output (I/O) interface 606.

The processor 602 includes one or more processors operably coupled to the memory 604. The processor 602 is any electronic circuitry including, but not limited to, state machines, one or more central processing unit (CPU) chips, logic units, cores (e.g. a multi-core processor), field-programmable gate array (FPGAs), application specific integrated circuits (ASICs), or digital signal processors (DSPs) that communicatively couples to memory 604 and controls the operation of HVAC system 100. The processor 602 may be a programmable logic device, a microcontroller, a microprocessor, or any suitable combination of the preceding. The processor 602 is communicatively coupled to and in signal communication with the memory 604. The one or more processors are configured to process data and may be implemented in hardware or software. For example, the processor 602 may be 8-bit, 16-bit, 32-bit, 64-bit or of any other suitable architecture. The processor 602 may include an arithmetic logic unit (ALU) for performing arithmetic and logic operations, processor registers that supply operands to the ALU and store the results of ALU operations, and a control unit that fetches instructions from memory 604 and executes them by directing the coordinated operations of the ALU, registers, and other components. The processor may include other hardware and software that operates to process information, control the HVAC system 100, and perform any of the functions described herein (e.g., with respect to FIG. 3). The processor 602 is not limited to a single processing device and may encompass multiple processing devices. Similarly, the controller 144 is not limited to a single controller but may encompass multiple controllers.

The memory 604 includes one or more disks, tape drives, or solid-state drives, and may be used as an over-flow data storage device, to store programs when such programs are selected for execution, and to store instructions and data that are read during program execution. The memory 604 may be volatile or non-volatile and may include ROM, RAM, ternary content-addressable memory (TCAM), dynamic random-access memory (DRAM), and static random-access memory (SRAM). The memory 604 is operable to store one or more suction-side property measurements 608, liquid-side property measurements 610, and thresholds 612. The suction-side property measurements 608 generally include values of the suction-side property 108*b* measured by the suction-side sensor 108*a* of FIG. 1. For example, the suction-side property measurements 608 may include a record of previous values of the suction-side property 108*b* measured for the HVAC system 100. The liquid-side property measurements 610 generally include values of the liquid-side property 110*b* measured by the liquid-side sensor 110*a* of FIG. 1. For example, the liquid-side property measurements 610 may include a record of previous values of the liquid-side property 110*b* measured for the HVAC system 100. The threshold values 612 include any of the thresholds used to implement the functions described herein. For instance, the thresholds 612 may include the thresholds 218, 222, 226, 230, 248, 252, 256, 260, 278, 282, 286, 290 described with respect to FIGS. 2B-2D.

The I/O interface 606 is configured to communicate data and signals with other devices. For example, the I/O interface 606 may be configured to communicate electrical signals with components of the HVAC system 100 including the compressor 106, the suction-side sensor 108*a*, the liquid-side sensor 110*a*, the expansion device 118, the blower 132, sensors 136*a,b*, thermostat 138, and switches 146, 148. The I/O interface may receive, for example, signals associated with the suction-side property 108*b*, signals associated with the liquid-side property 110*b* thermostat calls, temperature setpoints, environmental conditions, and an operating mode status for the HVAC system 100 and send electrical signals to the components of the HVAC system 100. The I/O interface 606 may include ports or terminals for establishing signal communications between the controller 144 and other devices. The I/O interface 606 may be configured to enable wired and/or wireless communications.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

To aid the Patent Office, and any readers of any patent issued on this application in interpreting the claims appended hereto, applicants note that they do not intend any of the appended claims to invoke 35 U.S.C. § 112(f) as it exists on the date of filing hereof unless the words "means for" or "step for" are explicitly used in the particular claim.

What is claimed is:

1. Heating, ventilation and air conditioning (HVAC) system comprising:

a refrigerant conduit subsystem configured to allow a flow of refrigerant through the HVAC system;

a compressor configured to receive refrigerant and direct the refrigerant to flow through a refrigerant conduit subsystem;

a condenser configured to receive the refrigerant and allow heat transfer between the received refrigerant and a first flow of air across the condenser;

a fan configured to provide the first flow air across the condenser;

an evaporator configured to receive the refrigerant and allow heat transfer between the refrigerant and a second flow air across the evaporator;

a blower configured to provide the second flow of air across the evaporator;

a suction-side sensor positioned and configured to measure a suction-side property associated with refrigerant provided to an inlet of the compressor, wherein the suction-side property comprises at least one of a suction-side temperature or a suction-side pressure;

a liquid-side sensor positioned and configured to measure a liquid-side property associated with the refrigerant provided from an outlet of the compressor, wherein the liquid-side property comprises at least one of a liquid-side temperature or a liquid-side pressure; and a controller communicatively coupled to the suction-side sensor and the liquid-side sensor, the controller configured to:

monitor the suction-side property over a period of time;

monitor the liquid-side property over the period of time;

determine whether the suction-side property has an increasing or decreasing trend over the period of time;

determine whether the liquid-side property has an increasing or decreasing trend;

determine that a fan fault is detected if both the suction-side property and the liquid-side property are determined to have an increasing trend over the period of time;

determine that a blockage of the refrigerant conduit subsystem is detected if it is determined that the suction-side property has a decreasing trend and the liquid-side property has an increasing trend over the period of time; and determine that a blower fault is detected if it is determined that both the suction-side property and the liquid-side property have a decreasing trend over the period of time.

2. The system of claim 1, wherein the suction-side property is a suction-side pressure of the refrigerant measured at a position proximate the inlet of the compressor and the liquid-side property is a liquid-side pressure of the refrigerant measured at a position proximate the outlet of the compressor.

3. The system of claim 1, the controller further configured to:

determine whether the liquid-side pressure has an increasing or decreasing trend by:

determining a first rate of change of the liquid-side property over the period of time;

in response to determining that the first rate of change is positive and is greater than a first threshold value, determining that the liquid-side property has an increasing trend, and in response to determining that the positive first rate of change is positive and is not greater than the first threshold value, determining that the liquid-side property does not have an increasing trend;

in response to determining the first rate of change is negative and is less than a second threshold value, determining that the liquid-side property has a decreasing trend; and in response to determining that the first rate of change is negative and is not less than the second threshold value, determining that the liquid-side property does not have a decreasing trend; and determine whether the suction-side pressure has an increasing or decreasing trend by:

determining a second rate of change of the suction-side property over the period of time;

in response to determining that the second rate of change is positive and is greater than a third threshold value, determining that the suction-side property has an increasing trend;

in response to determining that the second rate of change is positive and is not greater than the third threshold value, determining that the suction-side property does not have an increasing trend; and in response to determining the second rate of change is negative and is less than a fourth threshold value, determining that the suction-side property has a decreasing trend; and in response to determining that the second rate of change is negative and is not less than the fourth threshold value, determining that the suction-side property does not have a decreasing trend.

4. The system of claim 1, the controller further configured to:

determine whether the liquid-side property has an increasing or decreasing trend by:

determining a first value of the liquid-side property at a first time stamp during the period of time;

determining a second value of the liquid-side property at a second time stamp during the period of time, wherein the second time stamp corresponds to a predefined time after the first time stamp;

determining a liquid-side difference between the second value and the first value;

in response to determining that the liquid-side difference is positive and greater than a first threshold value, determining that the liquid-side property is increasing; and in response to determining that the liquid-side difference is negative and less than a second threshold value, determining that the liquid-side property is decreasing; and determine whether the suction-side property has an increasing or decreasing trend by:

determining a third value of the suction-side property at the first time stamp during the period of time;

determining a fourth value of the suction-side property at the second time stamp during the period of time;

determining a suction-side difference between the fourth value and the third value;

in response to determining that the suction-side difference is positive and greater than a third threshold value, determining that the suction-side property is increasing; and in response to determining that the suction-side difference is negative and less than a fourth threshold value, determining that the suction-side property is decreasing.

5. The system of claim 1, the controller further configured to:

determine whether the liquid-side property has an increasing or decreasing trend by:

determining, for each of at least three sequential intervals of time during the period of time, a first value of the liquid-side property at a start of the interval of time;

determining, for each of the at least three sequential intervals of time, a second value of the liquid-side property at an end of the interval of time;

determining, for each of the at least three sequential intervals of time, a liquid-side difference between the second value and the first value for the interval of time;

in response to determining that, for each of the at least three sequential intervals of time, the liquid-side difference is positive and greater than a first threshold value, determining that the liquid-side property is increasing; and in response to determining that, for each of the at least three sequential intervals in response to determining that, for each of the at least three sequential intervals of time, the liquid-side difference is negative and less than a second threshold value, determining that the liquid-side property is decreasing; and determine whether the suction-side property has an increasing or decreasing trend by:

determining, for each of the at least three sequential intervals of time, a third value of the suction-side property at the start of the interval of time;

determining, for each of the at least three sequential intervals of time, a fourth value of the suction-side property at the end of the interval of time;

determining, for each of the at least three sequential intervals of time, a suction-side difference between the fourth value and the third value for the interval of time;

in response to determining that, for each of the at least three sequential intervals of time, the suction-side difference is positive and greater than a third threshold value, determining that the suction-side property is increasing; and in response to determining that, for each of the at least three sequential intervals in response to determining that, for each of the at least three sequential intervals of time, the suction-side difference is negative and less than a fourth threshold value, determining that the suction-side property is decreasing.

6. The system of claim 1, the controller further configured to:

in response to determining that the fan fault is detected, cause communication of a fan-malfunction alert;

in response to determining that the blockage of the refrigerant conduit subsystem is detected, cause communication of a conduit-blockage alert;

in response to determining that the blower fault is detected, cause communication of a blower-malfunction alert.

7. The system of claim 1, the controller further configured to, in response to, in response to determining that the fan fault is detected, stop operation of the HVAC system.

8. A method of operating heating, ventilation and air conditioning (HVAC) system, the method comprising:

monitoring, over a period of time, a suction-side property associated a refrigerant provided to an inlet of a compressor of the HVAC system, wherein the suction-side property comprises at least one of a suction-side temperature or a suction-side pressure;

monitoring, over the period of time, a liquid-side property associated with the refrigerant provided from an outlet of the compressor, wherein the liquid-side property comprises at least one of a liquid-side temperature or a liquid-side pressure;

determining whether the suction-side property has an increasing or decreasing trend over the period of time;

determining whether the liquid-side property has an increasing or decreasing trend;

in response to determining that both the suction-side property and the liquid-side property are determined to have an increasing trend over the period of time, determining that a fan fault is detected;

in response to determining that the suction-side property has a decreasing trend and the liquid-side property has an increasing trend over the period of time, determining that a blockage of the refrigerant conduit subsystem is detected; and in response to determining that both the suction-side property and the liquid-side property have a decreasing trend over the period of time, determining that a blower fault is detected.

9. The method of claim 8, wherein the suction-side property is a suction-side pressure of the refrigerant measured at a position proximate the inlet of the compressor and the liquid-side property is a liquid-side pressure of the refrigerant measured at a position proximate the outlet of the compressor.

10. The method of claim 8, further comprising:

determining whether the liquid-side pressure has an increasing or decreasing trend by:

determining a first rate of change of the liquid-side property over the period of time;

in response to determining that the first rate of change is positive and is greater than a first threshold value, determining that the liquid-side property has an increasing trend; and in response to determining that the positive first rate of change is positive and is not greater than the first threshold value, determining that the liquid-side property does not have an increasing trend;

in response to determining the first rate of change is negative and is less than a second threshold value, determining that the liquid-side property has a decreasing trend; and in response to determining that the first rate of change is negative and is not less than the second threshold value, determining that the liquid-side property does not have a decreasing trend; and determining whether the suction-side pressure has an increasing or decreasing trend by:

determining a second rate of change of the suction-side property over the period of time;

in response to determining that the second rate of change is positive and is greater than a third threshold value, determining that the suction-side property has an increasing trend;

in response to determining that the second rate of change is positive and is not greater than the third threshold value, determining that the suction-side property does not have an increasing trend; and in response to determining the second rate of change is negative and is less than a fourth threshold value, determining that the suction-side property has a decreasing trend; and in response to determining that the second rate of change is negative and is not less than the fourth threshold value, determining that the suction-side property does not have a decreasing trend.

11. The method of claim 8, further comprising:

determining whether the liquid-side property has an increasing or decreasing trend by:

determining a first value of the liquid-side property at a first time stamp during the period of time;

determining a second value of the liquid-side property at a second time stamp during the period of time, wherein the second time stamp corresponds to a predefined time after the first time stamp;

determining a liquid-side difference between the second value and the first value;

in response to determining that the liquid-side difference is positive and greater than a first threshold value, determining that the liquid-side property is increasing; and in response to determining that the liquid-side difference is negative and less than a second threshold value, determining that the liquid-side property is decreasing; and determining whether the suction-side property has an increasing or decreasing trend by:

determining a third value of the suction-side property at the first time stamp during the period of time;

determining a fourth value of the suction-side property at the second time stamp during the period of time;

determining a suction-side difference between the fourth value and the third value;

in response to determining that the suction-side difference is positive and greater than a third threshold value, determining that the suction-side property is increasing; and in response to determining that the suction-side difference is negative and less than a fourth threshold value, determining that the suction-side property is decreasing.

12. The method of claim 8, further comprising:

determining whether the liquid-side property has an increasing or decreasing trend by:

determining, for each of at least three sequential intervals of time during the period of time, a first value of the liquid-side property at a start of the interval of time;

determining, for each of the at least three sequential intervals of time, a second value of the liquid-side property at an end of the interval of time;

determining, for each of the at least three sequential intervals of time, a liquid-side difference between the second value and the first value for the interval of time;

in response to determining that, for each of the at least three sequential intervals of time, the liquid-side difference is positive and greater than a first threshold value, determining that the liquid-side property is increasing; and in response to determining that, for each of the at least three sequential intervals in response to determining that, for each of the at least three sequential intervals of time, the liquid-side difference is negative and less than a second threshold value, determining that the liquid-side property is decreasing; and determining whether the suction-side property has an increasing or decreasing trend by:

determining, for each of the at least three sequential intervals of time, a third value of the suction-side property at the start of the interval of time;

determining, for each of the at least three sequential intervals of time, a fourth value of the suction-side property at the end of the interval of time;

determining, for each of the at least three sequential intervals of time, a suction-side difference between the fourth value and the third value for the interval of time;

in response to determining that, for each of the at least three sequential intervals of time, the suction-side difference is positive and greater than a third threshold value, determining that the suction-side property is increasing; and in response to determining that, for each of the at least three sequential intervals in response to determining that, for each of the at least three sequential intervals of time, the suction-side difference is negative and less than a fourth threshold value, determining that the suction-side property is decreasing.

13. The method of claim 8, further comprising:

in response to determining that the fan fault is detected, causing communication of a fan-malfunction alert;

in response to determining that the blockage of the refrigerant conduit subsystem is detected, causing communication of a conduit-blockage alert;

in response to determining that the blower fault is detected, causing communication of a blower-malfunction alert.

14. The method of claim 8, further comprising, in response to, in response to determining that the fan fault is detected, stopping operation of the HVAC system.

15. A controller of a heating, ventilation and air conditioning (HVAC) system, the controller comprising:

an input/output interface configured communicatively couple the controller to:

a suction-side sensor positioned and configured to measure a suction-side property associated with refrigerant provided to an inlet of a compressor of the HVAC system, wherein the suction-side property comprises at least one of a suction-side temperature or a suction-side pressure; and a liquid-side sensor positioned and configured to measure a liquid-side property associated with the refrigerant provided from an outlet of the compressor, wherein the liquid-side property comprises at least one of a liquid-side temperature or a liquid-side pressure; and a processor, coupled to the input/output interface, the processor configured to:

monitor the suction-side property over a period of time;

monitor the liquid-side property over the period of time;

determine whether the suction-side property has an increasing or decreasing trend over the period of time;

determine whether the liquid-side property has an increasing or decreasing trend;

determine that a fan fault is detected if both the suction-side property and the liquid-side property are determined to have an increasing trend over the period of time;

determine that a blockage of the refrigerant conduit subsystem is detected if it is determined that the suction-side property has a decreasing trend and the liquid-side property has an increasing trend over the period of time; and determine that a blower fault is detected if it is determined that both the suction-side property and the liquid-side property have a decreasing trend over the period of time.

16. The controller of claim 15, wherein the suction-side property is a suction-side pressure of the refrigerant measured at a position proximate the inlet of the compressor and the liquid-side property is a liquid-side pressure of the refrigerant measured at a position proximate the outlet of the compressor.

17. The controller of claim 15, the processor further configured to:

determine whether the liquid-side pressure has an increasing or decreasing trend by:

determining a first rate of change of the liquid-side property over the period of time;

in response to determining that the first rate of change is positive and is greater than a first threshold value, determining that the liquid-side property has an increasing trend; and in response to determining that the positive first rate of change is positive and is not greater than the first threshold value, determining that the liquid-side property does not have an increasing trend;

in response to determining the first rate of change is negative and is less than a second threshold value, determining that the liquid-side property has a decreasing trend; and in response to determining that the first rate of change is negative and is not less than the second threshold value, determining that the liquid-side property does not have a decreasing trend; and determine whether the suction-side pressure has an increasing or decreasing trend by:

determining a second rate of change of the suction-side property over the period of time;

in response to determining that the second rate of change is positive and is greater than a third threshold value, determining that the suction-side property has an increasing trend;

in response to determining that the second rate of change is positive and is not greater than the third threshold value, determining that the suction-side property does not have an increasing trend; and in response to determining the second rate of change is negative and is less than a fourth threshold value, determining that the suction-side property has a decreasing trend; and in response to determining that the second rate of change is negative and is not less than the fourth threshold value, determining that the suction-side property does not have a decreasing trend.

18. The controller of claim 15, the processor further configured to:

determine whether the liquid-side property has an increasing or decreasing trend by:

determining a first value of the liquid-side property at a first time stamp during the period of time;

determining a second value of the liquid-side property at a second time stamp during the period of time, wherein the second time stamp corresponds to a predefined time after the first time stamp;

determining a liquid-side difference between the second value and the first value;

in response to determining that the liquid-side difference is positive and greater than a first threshold value, determining that the liquid-side property is increasing; and in response to determining that the liquid-side difference is negative and less than a second threshold value, determining that the liquid-side property is decreasing; and determine whether the suction-side property has an increasing or decreasing trend by:

determining a third value of the suction-side property at the first time stamp during the period of time;

determining a fourth value of the suction-side property at the second time stamp during the period of time;

determining a suction-side difference between the fourth value and the third value;

in response to determining that the suction-side difference is positive and greater than a third threshold value, determining that the suction-side property is increasing; and in response to determining that the suction-side difference is negative and less than a fourth threshold value, determining that the suction-side property is decreasing.

19. The controller of claim 15, the processor further configured to:

determine whether the liquid-side property has an increasing or decreasing trend by:

determining, for each of at least three sequential intervals of time during the period of time, a first value of the liquid-side property at a start of the interval of time;

determining, for each of the at least three sequential intervals of time, a second value of the liquid-side property at an end of the interval of time;

determining, for each of the at least three sequential intervals of time, a liquid-side difference between the second value and the first value for the interval of time;

in response to determining that, for each of the at least three sequential intervals of time, the liquid-side difference is positive and greater than a first threshold value, determining that the liquid-side property is increasing; and in response to determining that, for each of the at least three sequential intervals in response to determining that, for each of the at least three sequential intervals of time, the liquid-side difference is negative and less than a second threshold value, determining that the liquid-side property is decreasing; and determine whether the suction-side property has an increasing or decreasing trend by:

determining, for each of the at least three sequential intervals of time, a third value of the suction-side property at the start of the interval of time;

determining, for each of the at least three sequential intervals of time, a fourth value of the suction-side property at the end of the interval of time;

determining, for each of the at least three sequential intervals of time, a suction-side difference between the fourth value and the third value for the interval of time;

in response to determining that, for each of the at least three sequential intervals of time, the suction-side difference is positive and greater than a third threshold value, determining that the suction-side property is increasing; and in response to determining that, for each of the at least three sequential intervals in response to determining that, for each of the at least three sequential intervals of time, the suction-side difference is negative and less than a fourth threshold value, determining that the suction-side property is decreasing.

20. The controller of claim 15, the processor further configured to:

in response to determining that the fan fault is detected, cause communication of a fan-malfunction alert;

in response to determining that the blockage of the refrigerant conduit subsystem is detected, cause communication of a conduit-blockage alert;

in response to determining that the blower fault is detected, cause communication of a blower-malfunction alert.

* * * * *